US008312577B2

(12) United States Patent
Bock

(10) Patent No.: US 8,312,577 B2
(45) Date of Patent: Nov. 20, 2012

(54) SIDE GRATE

(75) Inventor: Klaus Bock, Verl (DE)
(73) Assignee: Spiroplex GmbH (DE)

( * ) Notice: Subject to any disclaimer, the term of this patent is extended or adjusted under 35 U.S.C. 154(b) by 413 days.

(21) Appl. No.: 12/530,810
(22) PCT Filed: Mar. 13, 2008
(86) PCT No.: PCT/EP2008/001989
§ 371 (c)(1),
(2), (4) Date: Sep. 11, 2009
(87) PCT Pub. No.: WO2008/110361
PCT Pub. Date: Sep. 18, 2008

(65) Prior Publication Data

US 2010/0088817 A1 Apr. 15, 2010

(30) Foreign Application Priority Data

Mar. 14, 2007 (DE) ..... 20 2007 003 808 U

(51) Int. Cl.
*A47C 21/08* (2006.01)
(52) U.S. Cl. ..... 5/429; 5/424; 5/425
(58) Field of Classification Search ..... 5/81.1 R, 5/424, 428–430, 658, 662
See application file for complete search history.

(56) References Cited

U.S. PATENT DOCUMENTS

| | | | | |
|---|---|---|---|---|
| 2,981,959 | A * | 5/1961 | Burnham | 5/503.1 |
| 3,286,283 | A * | 11/1966 | Bertoldo | 5/662 |
| 3,921,233 | A | 11/1975 | Mann | |
| 4,752,977 | A | 6/1988 | Smith et al. | |
| 5,279,010 | A | 1/1994 | Ferrand et al. | |
| 5,384,927 | A | 1/1995 | Mardero et al. | |
| 6,058,531 | A | 5/2000 | Carroll | |
| 6,076,209 | A | 6/2000 | Paul | |
| 2006/0130239 | A1 | 6/2006 | Smith | |

FOREIGN PATENT DOCUMENTS

| | | | |
|---|---|---|---|
| DE | 202005005794 | U1 | 8/2005 |
| WO | WO-2004060257 | A2 | 7/2004 |

* cited by examiner

*Primary Examiner* — Fredrick Conley
(74) *Attorney, Agent, or Firm* — Harness, Dickey & Pierce, P.L.C.

(57) ABSTRACT

The invention relates to a side grate for a bed, particularly for a hospital bed and/or a nursing bed. In order to provide a side grate configured in a novel manner, the invention provides a side grate that is supported on a support post (34) of the bed in a height adjustable manner on the end, and in a freestanding manner on the other side.

14 Claims, 8 Drawing Sheets

SIDE GRATE

Figure 1:
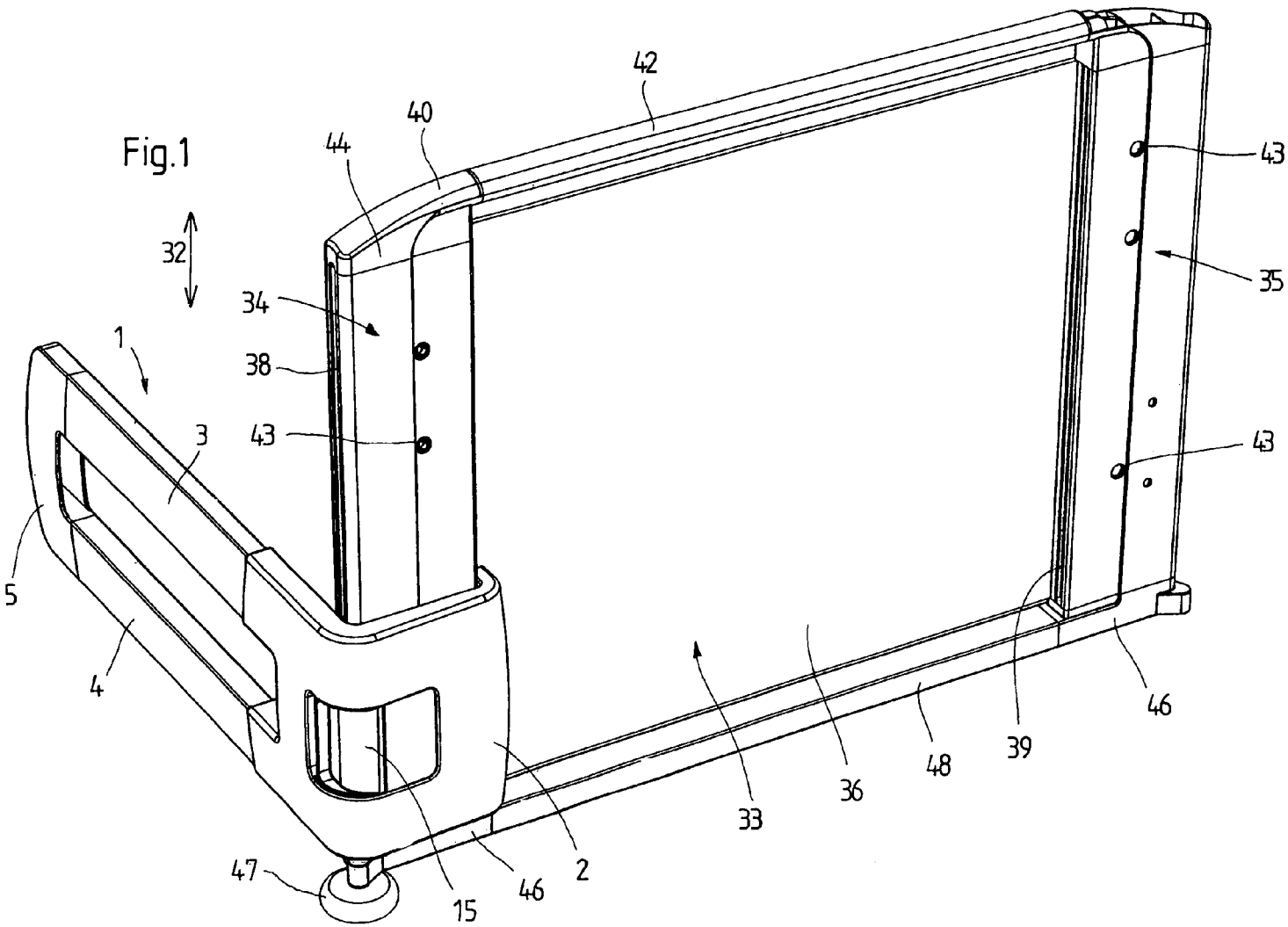

The invention relates to a side grate for a bed, particularly for a hospital bed and/or a nursing bed.

Side grates for beds in general and side grates for hospital beds and/or nursing beds in particular are known from prior art as are beds as such. For this reason any separate documentary proof is not required at this point.

Side grates are normally used as a barrier for the longitudinal sides of a bed, if necessary, and especially to prevent an individual lying in bed from unintentionally falling out of the bed while sleeping for instance. Side grates in a most different design are especially used for hospital beds and/or nursing beds.

Side grates are known which are constructed as longitudinal bars that are arranged on the one and on the other end on the associated end part of the bed, i.e. on the head end part on one side and on the foot end part on the other side. Known side grates of this kind can be constructed for displacement in the vertical direction.

Further known from prior art are side grates which are arranged on the bed frame and/or on the supporting frame of the bed and can be pivoted about a swivel axis extending transversely to the longitudinal extension of the bed.

If necessary, side grates constructed in this way can be pivotally moved or flipped from their stored position to their operative position.

Although prior art side grates for beds have proven themselves in practice, there is a need for improving such side grates. Accordingly, it is an object of the present invention to propose a novel side grate configuration.

To achieve this object, the invention proposes a side grate for a bed, particularly for a hospital bed and/or a nursing bed, which is supported on a support post of the bed in a height adjustable manner on one end side and in a freestanding manner on the other end side.

The side grate according to the invention is constructed in the fashion of an arm rest that has a cantilever or freestanding design on one end. On the other end the side grate is supported for height adjustment on a support post of the bed, for example on the support post of an end part of the bed.

Compared to side grates known from prior art, the side grate according to the invention is not supported on both sides thereof, but only on its one side and thus advantageously provides for additional possible uses. For instance, the side grate according to the invention can be easily moved to the desired elevation with a flick of the wrist. In a bed equipped for instance with up to four side grates of the invention, height adjustment of the individual side grates is possible independently from each other.

Advantageously, a side grate according to the invention comprises an adjustment device and a longitudinal bar arranged thereon. The adjustment device here serves to the height adjustable arrangement of the side grate on a support post. Preferably, the longitudinal bar is supported for twisting and/or displacement on the adjustment device. With the longitudinal bar being adjusted by the user to a desired position with respect to the adjustment device, the side grate can be advantageously used also as an arm rest, a storage facility or the like. Also, for easy access of the bed, a side grate which is configured in such a manner can be pivoted like a door or a gate, which fact all in all simplifies the handling.

According to a further feature of the invention the longitudinal bar can be constructed for telescoping in the longitudinal direction. This construction enables the side grate to be telescoped and thus extended in the longitudinal direction. It can be provided for example that the longitudinal bar of the side grate is hollow and receives therein an extension part which is guided for longitudinal displacement with respect to the longitudinal bar. This extension part can be displaced relative to the longitudinal bar and can be withdrawn from and pushed back into the longitudinal bar. The longitudinal bar and the extension part are preferably adjusted to each other with respect to the dimensions of the bed in the longitudinal direction in such a manner that when the extension part is fully extended at least 50% and preferably more than 50%, for example 51% or 52% of the longitudinal extension of the bed are covered. If the side grate covers at least 51% of the longitudinal extension of the bed, the bed side may be considered as a "closed" bed side. If side grates are provided on the opposite sides of a bed front, it is preferred that the same are adjusted to each other in such a way that they do not collide with each other when each of the extension parts is maximally displaced, but that at least one of the two side grates covers, when it is fully extended, 51% of the respective longitudinal side of the bed. According to this special configuration of the invention the other side grate of a longitudinal side, hence the one which does not cover 51% of the respective longitudinal side of the bed, even when it is fully extended, can be constructed as a side grate arranged on the bed for easy exchanging as a kind of retrofitting.

According to a further feature of the invention the adjustment device comprises a manually operable locking device. By means of this locking device the side grate can be locked in position with respect to the support post, and in the locked position of the side grate any unintentional height displacement of the side grate is prevented. Preferably, the locking device is constructed to be self-locking and so that it can be released by hand. The self-locking function of the locking device can be guaranteed for example by a spring member or the like.

The adjustment device can have guide strips. In the finally mounted state of the side grate as intended, these guide strips engage in guide grooves which are provided by the associated support post of the bed. The guide strips can slide within these guide grooves thus facilitating an easy height adjustment of the side grate with only little force being required. Moreover, thanks to the arrangement of guide grooves and guide strips, an arrangement of the side grate on the support post is made possible in a manner safe against twisting, i.e. against tilting with regard to the height extension of the bed. This is advantageous not only for reasons of safety.

According to a further feature of the invention at least one of the guide strips includes a position limiter. The same can be constructed for example as a kind of cam and engage in the guide groove associated with the guide strip. Within the guide groove limit stops are provided for the position limiter to strike against these limit stops thus effectively preventing the side grate from being moved too far upwardly or too far downwardly.

The invention also proposes a bed, preferably a hospital bed and/or a nursing bed, comprising a side grate of the above-described kind.

Figure 2:
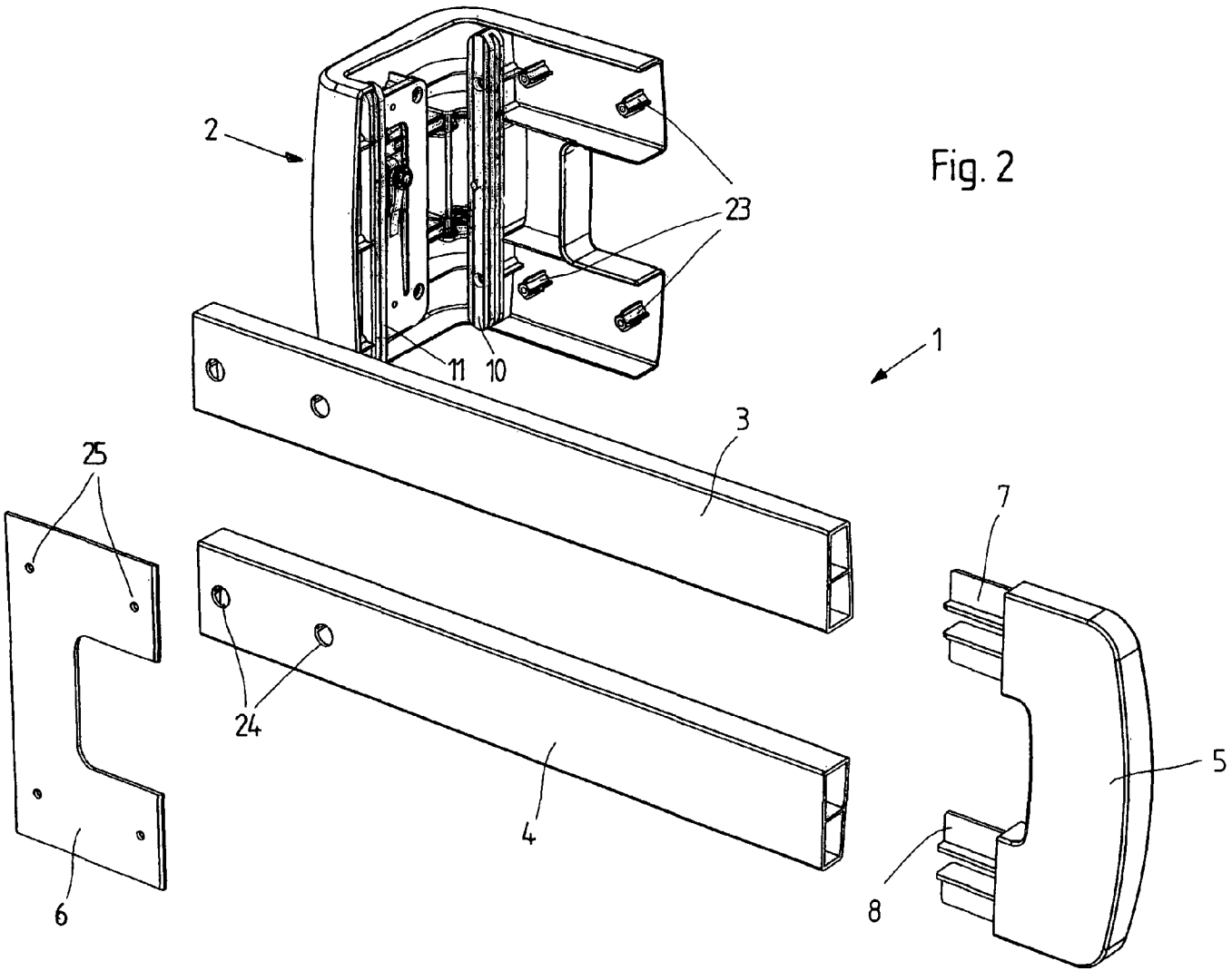
Figure 3:
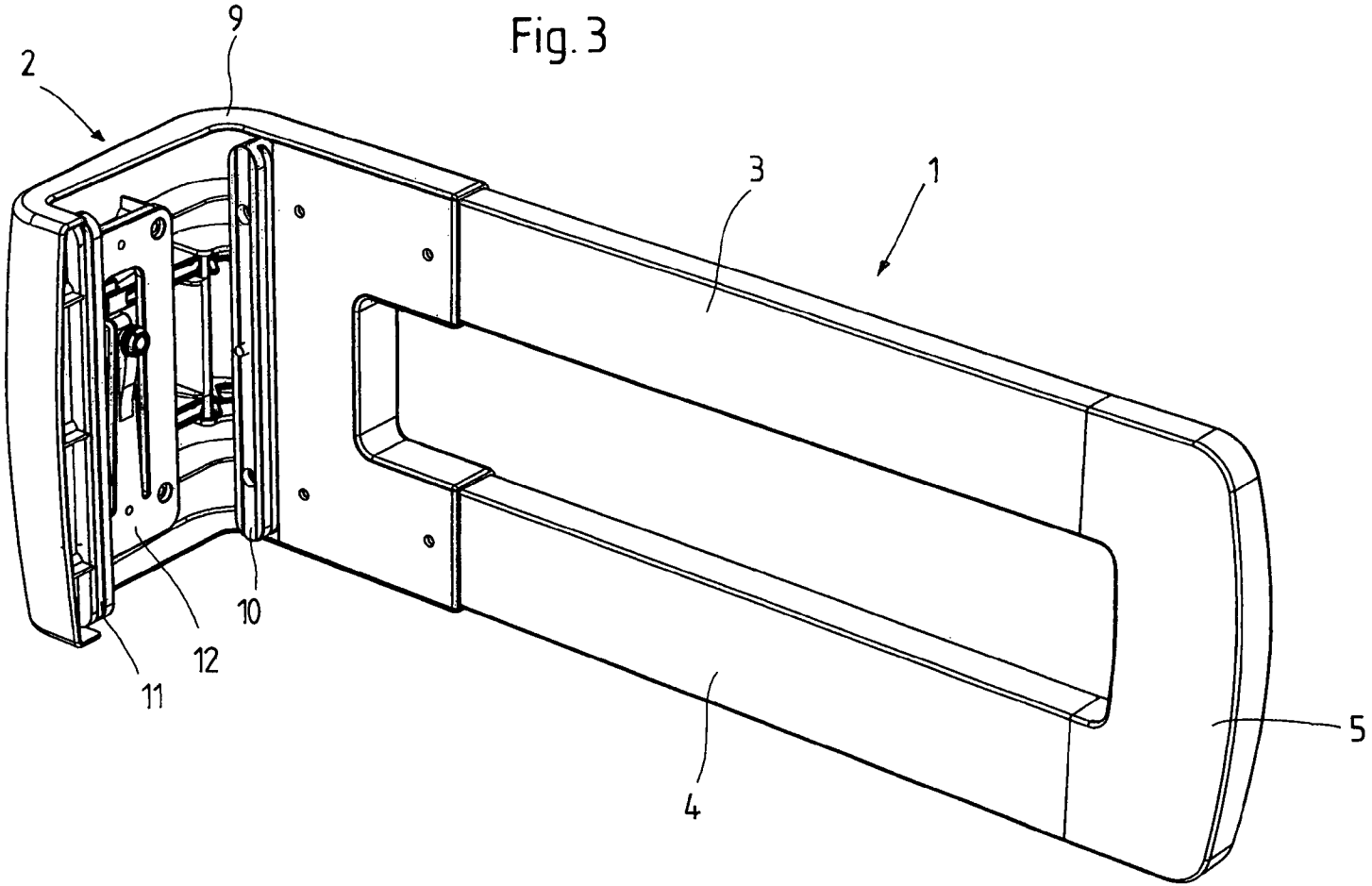
Figure 4:
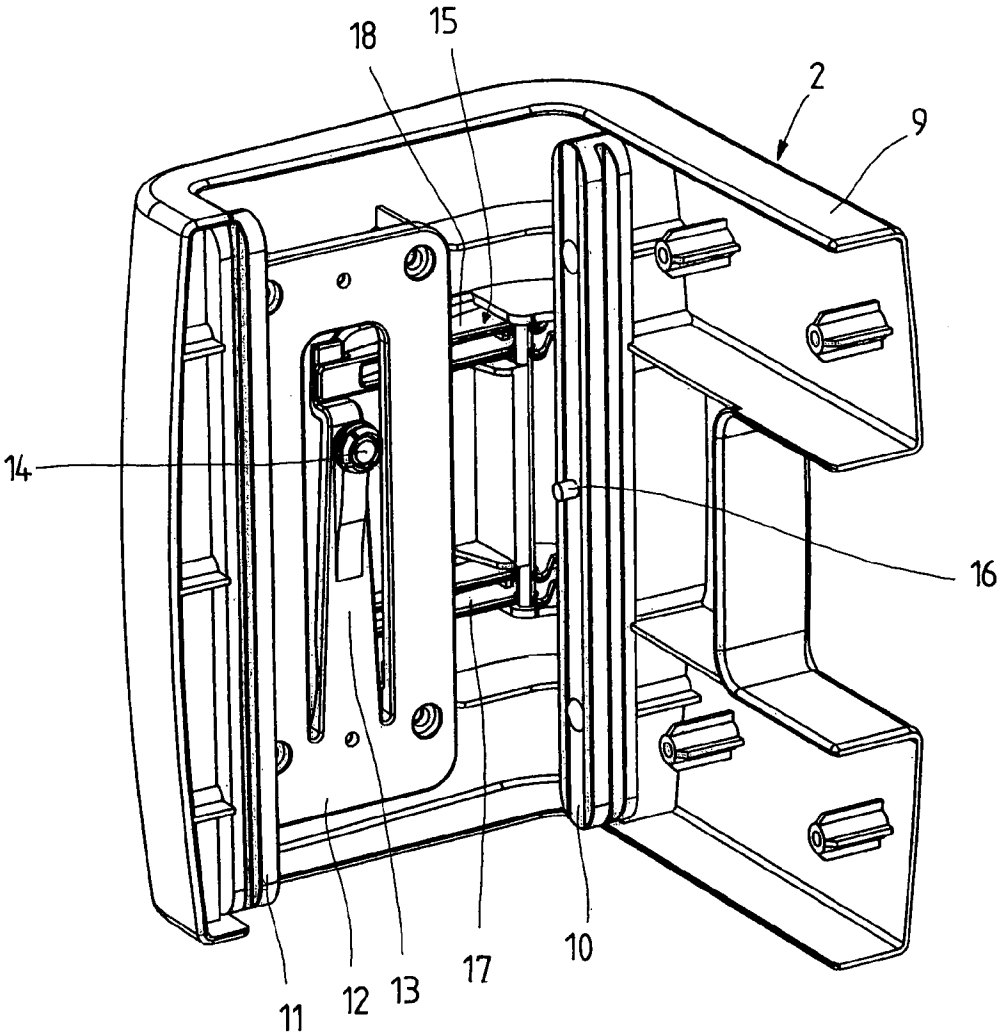
Figure 5:
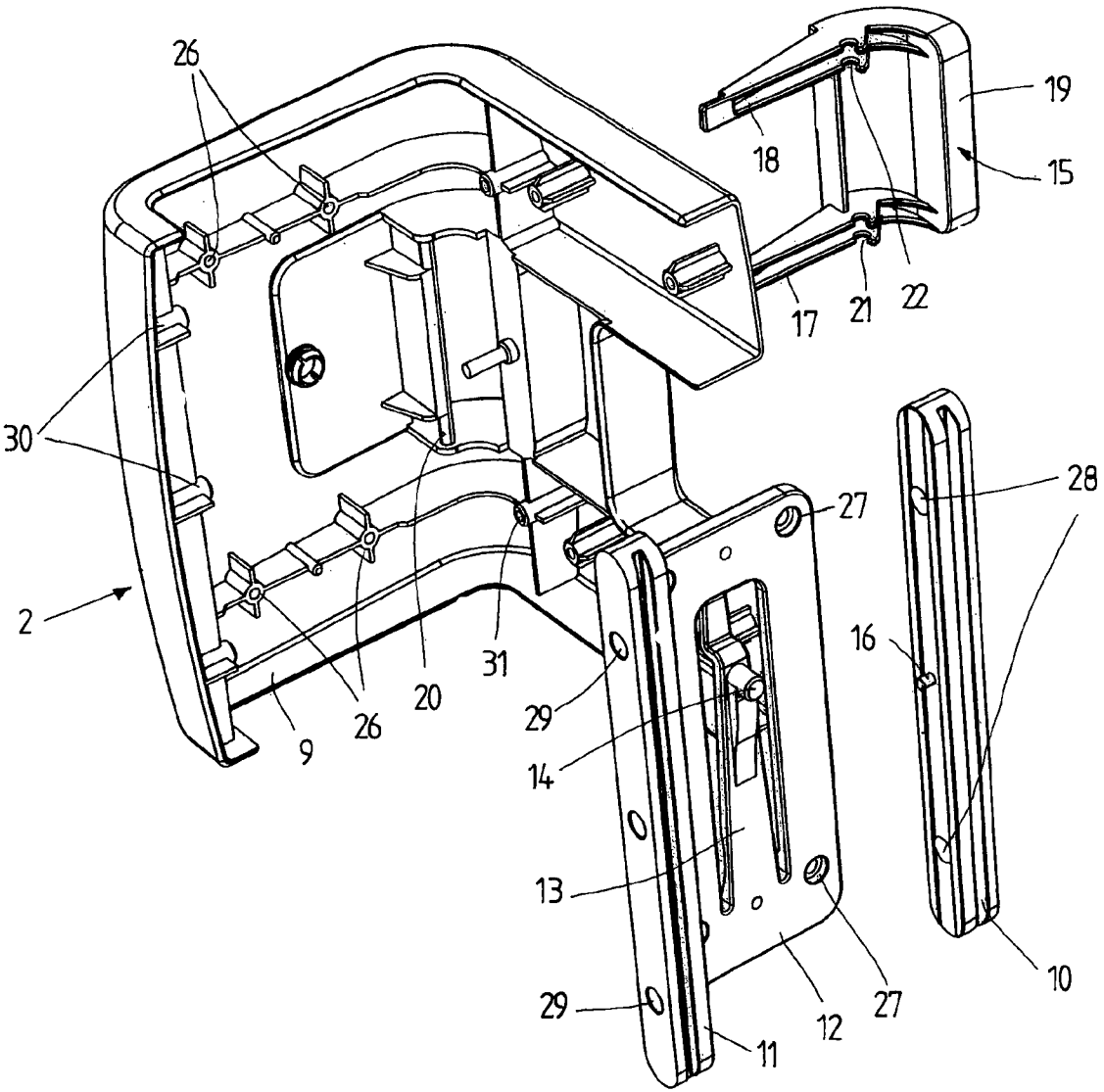
Figure 6:
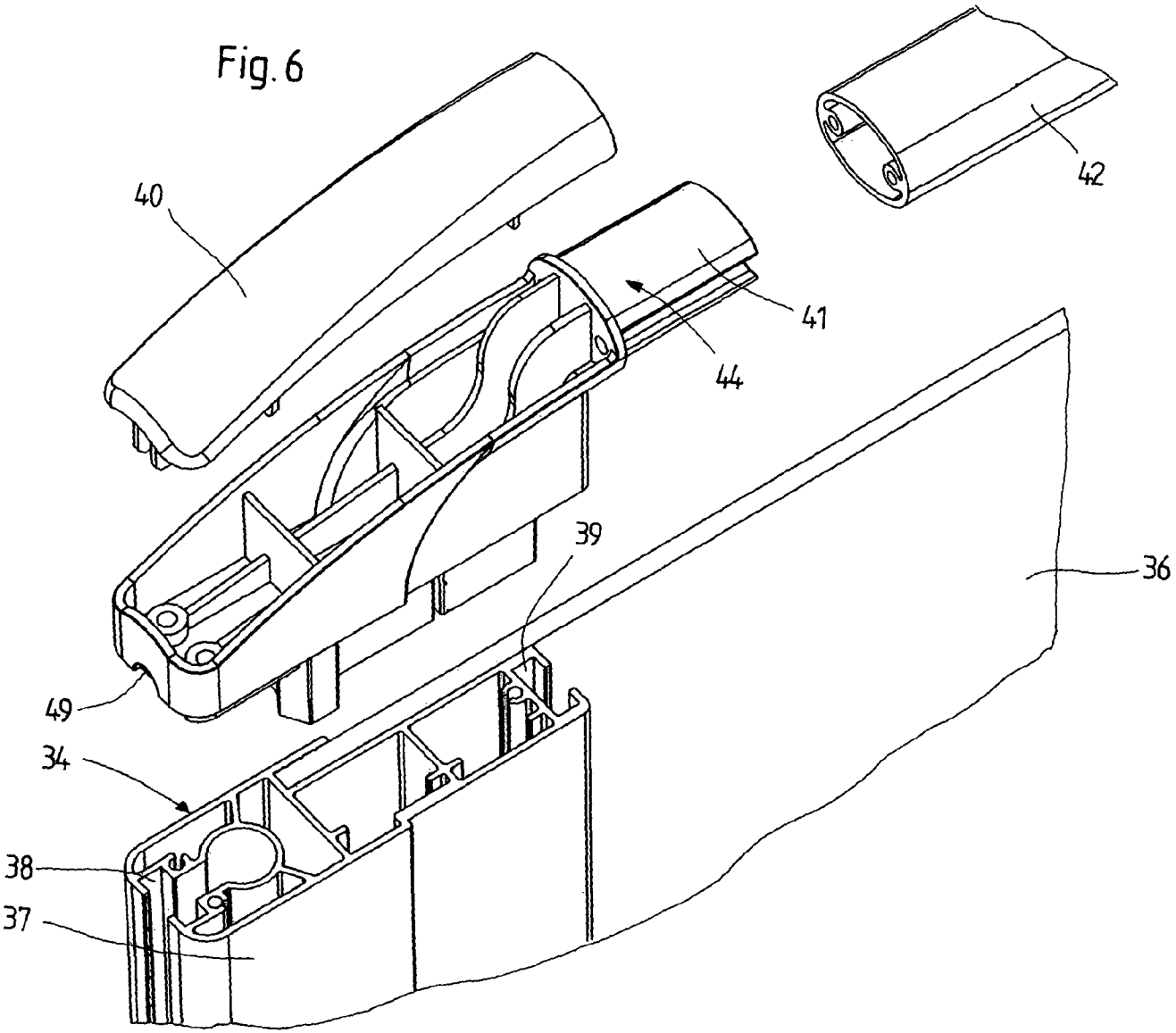
Figure 7:
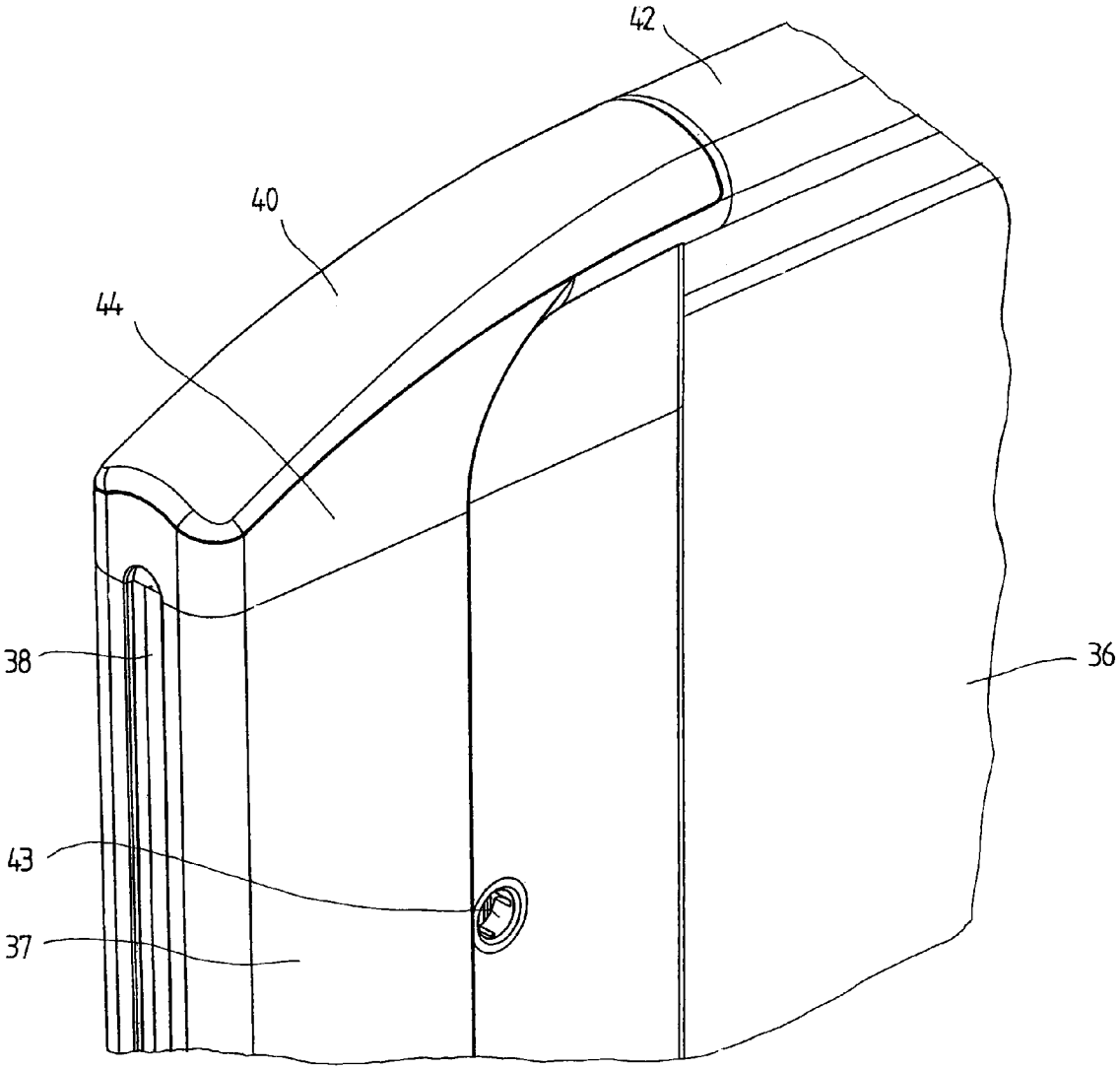
Figure 8:
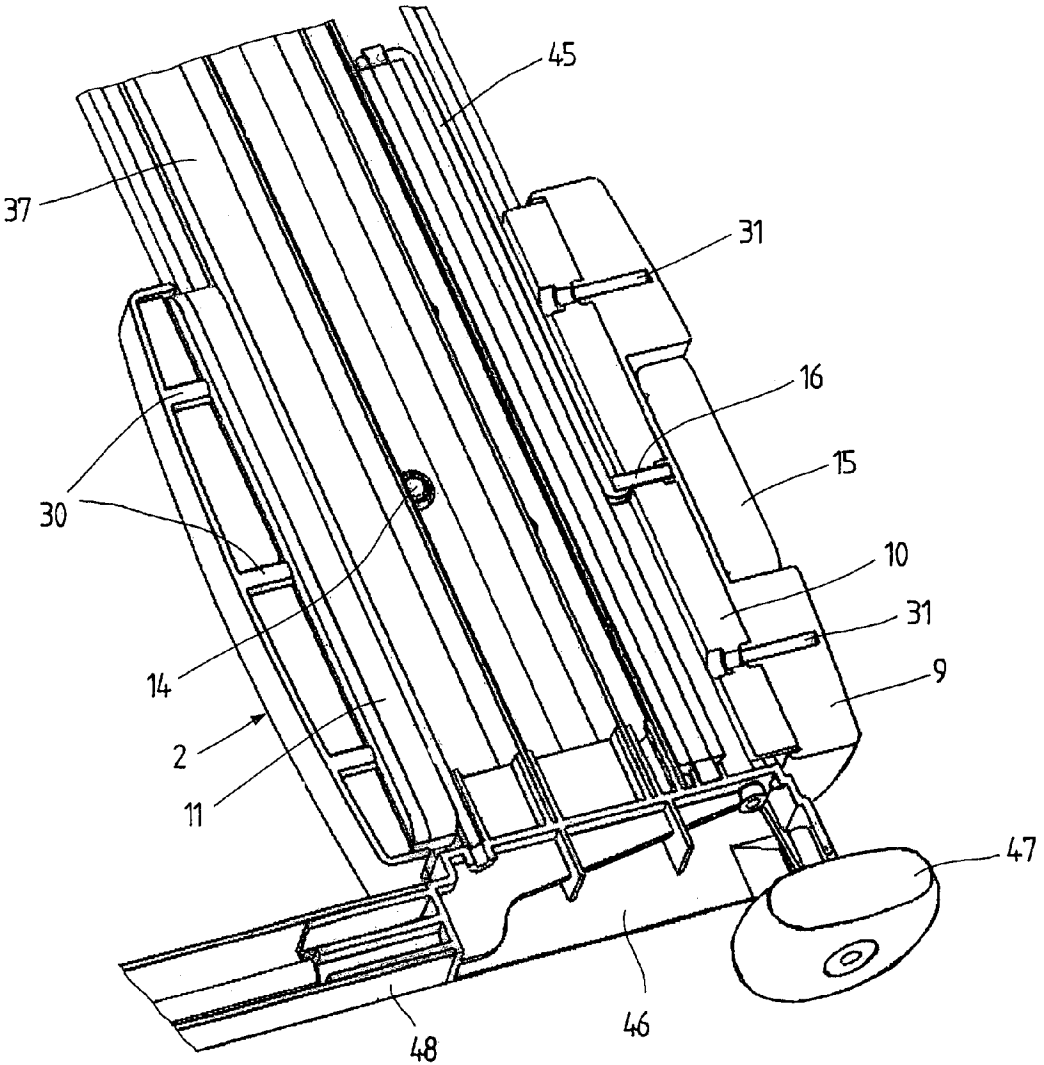

Further features and advantages of the present invention will become apparent from the following description with reference to the drawings wherein it is shown by FIG. 1 a schematic perspective view of the arrangement of a side grate according to the invention on an end part of a bed;

FIG. 2 a schematic perspective view of the main components of the side grate according to the invention;

FIG. 3 a schematic perspective view of a side grate according to the invention;

FIG. 4 a schematic perspective view of the adjustment device of the side grate according to the invention;

FIG. 5 a schematic perspective view of the main components of the adjustment device according to FIG. 4;

FIG. 6 a schematic perspective view of the individual components of the end part according to FIG. 1;

FIG. 7 an illustration of the assembly of the components according to FIG. 6 and FIG. 8 a schematic illustration in a partial sectional view of the adjustment device of the side grate according to the invention in a lower end position.

FIG. 1 schematically illustrates the end part 33 of a bed which is not further shown for sake of clarity. The end part 33 can for example be the head part or the foot part of a bed. Normally, between the head part on one side and the foot part on the other side a lie down area extends, which supports a mattress for instance. For the sake of clarity, these components are not illustrated in the drawing figures.

As can be recognized in FIG. 1, a side grate 1 of the type according to the invention is arranged for height adjustment on an end part 33. The side grate according to the invention is supported on a support post 34 of the end part 33 for height adjustment on one end side, namely in the height direction 32. On the other end side, i.e. on the side opposite to the support post 34, the side grate 1 is constructed freestanding, which means that side grate is not supported or otherwise held on the other end side. The side grate 1 is rather constructed to be freestanding in the room on the other end side.

The side grate 1 according to the invention is shown in more detail in the FIGS. 2 and 3. As illustrated in these figures, the side grate 1 comprises an adjustment device 2 and two longitudinal bars 3 and 4. In the mounted state of the side grate 1 the longitudinal bars 3 and 4 are connected, for example screwed to the housing part 9 of the adjustment device 2. For this purpose the housing part 9 includes hollow thread parts 23. The longitudinal bars 3 and 4 have corresponding bores 24. Screws, which are not illustrated in the FIGS. 2 and 3, are passed through these bores 24 and are screwed into the hollow thread parts 23 in the finally mounted state.

According to a preferred embodiment, which is shown in the FIGS. 2 and 3, a mounting plate 6 is used which also includes bores, namely bores 25, for passing-through fixing screws not further illustrated in the drawings.

As shown particularly by FIG. 2, the longitudinal bars 3 and 4 are constructed as hollow profiles. In the mounted state a closure 5, which is U-shaped in the illustrated embodiment, is pushed onto the longitudinal bars 3 and 4 on the side opposite the housing part 9 of the adjustment device 2. For the connection, preferably a clamping connection to the longitudinal bars 3 and 4 the closure 5 includes pins 7 and 8 which in the finally mounted state are received within the volume spaces of the longitudinal bars 3 and 4 constructed as hollow profiles. According to an alternative embodiment of the invention it can also be provided that the pins 7 and 8 are each constructed as extension parts that can be received in the volume space of the respective longitudinal bar 3 and 4 in a telescoping fashion. According to this alternative embodiment it is then possible to move the closure 5 with respect to the longitudinal bars 3 and 4, namely in the longitudinal direction of the longitudinal bars 3 and 4. Such an embodiment enables the closure 5, which is guided by the longitudinal bars 3 and 4, being selectively displaced in the longitudinal direction of the longitudinal bars 3 and 4, so that the side grate can be extended if necessary. The lengths of the longitudinal bars 3 and 4 and the lengths of the pins 7 and 8 are adjusted to each other in such a manner that when the closure 5 is fully extended the extension of the side grate in the longitudinal direction is such that preferably 51% of the longitudinal side of the bed are covered, so that the bed can be considered as being "closed" with regard to this longitudinal side. To prevent that the closure 5 with its pins 7 and 8 is pulled out too far from the longitudinal bars 3 and 4, the invention proposes that at least one of the longitudinal bars includes a retaining device which guarantees that the associated pin cannot unintentionally be withdrawn from the longitudinal bar.

The FIGS. 4 and 5 show the adjustment device 2 of the side grate according to the invention in a detailed view respectively. Here it can be seen that the adjustment device 2 includes a housing part 9. In the finally assembled state guide strips 10 and 11 are inserted in and for example screwed together with this housing part 9, for which purpose the housing part 9 includes corresponding hollow thread parts 30 and 31. Accordingly, the guide strips 10 respectively 11 have through bores 28 respectively 29 through which fixing screws can be passed.

The adjustment device 2 further comprises a locking device 12 which too can be connected to the housing part 9 by means of screws. For this purpose hollow thread parts 26 are formed on the housing part. The locking device 12 comprises corresponding bores 27 and an arm 13 elastically coupled to it. The arm 13 comprises a pin-like cam 14. In a locked position of the side grate the cam 14 of the locking device 12 engages in a recess 43 that is formed on the support post 34 and that can be seen for example in FIG. 1. When the side grate 1 is in a locked position, the cam 14 of the locking device 12 hence engages in a recess 43 and thus prevents an unintentional displacement of the side grate 1 in the height direction. To release the locking, the handle 15 of the adjustment device must be operated.

As shown particularly by FIG. 5, the handle 15 comprises two arms 17 and 18, an operating section 19 and two seats 21 and 22. In the finally assembled state the seats 21 and 22 surround a shaft 20 formed within the housing part 9 of the adjustment device 2 thus enabling a twisting movement of the handle 15 relative to the housing part 9 of the adjustment device 2. At the same time the arms 17 and 18 of the handle 15 surround the resilient arm 13 of the locking device 12 in the finally mounted state of the side grate 1. Due to this construction it is possible to deflect the arm 13 of the locking device 12 in such a manner that the cam 14 of the arm 13 is disengaged from the recess 43. When the cam 14 is in a state disengaged from the recess 43, the side grate 1 can be adjusted in its height relative to the support post 34.

The end part 33 shown in FIG. 1 includes a support post 34 on the left side with respect to the drawing plane and a support post 35 on the right side with respect to the drawing plane. Between the two support posts 34 and 35 a plate 36 is arranged, as it can be seen for example in FIG. 6.

The support post 34, which is partially shown in the FIGS. 6 and 7, is comprised of a profile element 37. This profile element 37 provides two guide grooves, namely the guide grooves 38 and 39. In the finally mounted state of the side grate 1, as illustrated in FIG. 1, the guide strips 10 and 11 provided by the side grate 1 engage in these guide grooves. The guide strip 10 engages in the guide groove 38 and the guide strip 11 engages in the guide groove 39.

With reference to the drawing plane according to FIG. 6, the profile element forming the support post 34 is closed on its upper side by a closure part 44. When the closure part 44 is removed, as illustrated in FIG. 6, the adjustment device 2 of the side grate 1 can be threaded into the guide grooves 38 and 39 provided by the profile element 37 and the side grate thus arranged on the end part 33.

As it can be seen particularly in FIG. 6, the closure part 44 has an appendix 41. This appendix 41 serves for example to the arrangement of a closing bar 42 which can be seen at best in FIG. 1. The closing bar 42 extends above the plate 36 with regard to the drawing plane of FIG. 1 and mutually secures both closure parts 44 of the support post 34 on one side and of the support post 35 on the other. As can be readily seen from FIG. 6 or FIG. 7, the closure part 44 is closed on its upper side with a cap 40.

FIG. 8 shows in a partially sectional detailed representation the construction according to FIG. 1 in a rear view. It can be seen here that the side grate 1 is locked in the lower position. The cam 14 of the locking device 12 penetrates through the recess 43. Accordingly, the side grate 1 can be moved in the height direction only after having previously released the locking device 12 through the handle 15.

It can be readily seen from the illustration in FIG. 8 that the position limiter arranged on the guide strip 10 rests against the limit stop 45. Thus any further downward movement of the side grate 1 is not possible.

FIG. 8 further shows that the profile element 37 forming the support post 34 is attached to a connecting part 46. The connecting part 46 has attached to it a wall spacer roll 47 on one part and a lower longitudinal bar 48. The lower longitudinal bar 48 extends quasi parallel to the closing bar 42, as can be seen particularly in FIG. 1, namely with reference to the drawing plane of FIG. 1 below the plate 36 between the two support posts 34 and 35.

As explained above with reference to FIG. 8, the side grate 1 is not only prevented from being moved too far downwardly, but also from being moved too far upwardly. The closure part 44, which is shown for example in FIG. 6, serves as a limit stop for the position limiter 16. This closure part 44 includes a corresponding recess 49 for receiving the position limiter in the upper position.

The above explanation with reference to the FIGS. 1 to 8 has shown that the side grate 1 is characterized by its height adjustable configuration, namely in such a manner that it supported for height adjustment on the end part of the bed on one end side and configured in a cantilever fashion on the other end side.

LIST OF REFERENCE NUMBERS

1 side grate
2 adjustment device
3 longitudinal bar
4 longitudinal bar
5 closure
6 mounting plate
7 pin
8 pin
9 housing part
10 guide strip
11 guide strip
12 locking device
13 arm
14 cam
15 handle
16 position limiter
17 arm
18 arm
19 operating section
20 shaft
21 seat
22 seat
23 hollow thread part
24 bore
25 bore
26 hollow thread part
27 bore
28 bore
29 bore
30 hollow thread part
31 hollow thread part
32 height direction
33 end part
34 support post
35 support post
36 plate
37 profile element
38 guide groove
39 guide groove
40 cap
41 appendix
42 closing bar
43 recess
44 closure part
45 limit stop
46 connecting part
47 wall spacer roll
48 lower longitudinal bar
49 recess

The invention claimed is:

1. Side grate for a bed, particularly for a hospital bed and/or a nursing bed, which side grate is supported on a support post of an end part of the bed in a height adjustable manner on the one end and in a freestanding manner on the other end, the side grate includes an adjustment device coupled to the support post and a longitudinal bar extending from the support post that is configured to telescope longitudinally;

wherein the adjustment device includes guide strips formed in a manner corresponding to guide grooves provided by the support post.

2. Side grate according to claim 1, wherein the support post is at one of a head end or a foot end of the bed.

3. Side grate according to claim 1, wherein the longitudinal bar is arranged for twisting and/or displacement on the adjustment device.

4. Side grate according to claim 1, wherein the adjustment device includes a manually operated locking device.

5. A bed, in particular a hospital bed and/or nursing bed, using a side grate according to claim 1.

6. Side grate according to claim 1, wherein at least one of the guide strips includes a position limiter.

7. A side grate for a bed including a head end, a foot end, and a pair of longitudinal sides extending between the head end and the foot end, the side grate comprising:

a first end configured to slidably cooperate with a support post at one of the head end or the foot end of the bed;

a longitudinal member extending from the first end of the side grate and configured to extend generally parallel to at least one of the pair of longitudinal sides; and a second end opposite to the first end, the second end is configured to be suspended in a freestanding manner through cooperation between the first end and the support post, the longitudinal member is between the first end and the second end;

wherein the first end includes a first rail configured to slidably cooperate with a first guide groove of the support post and a second rail configured to slidably cooperate with a second guide groove of the support post.

8. The side grate of claim 7, wherein the first end includes an adjustment device and a transverse portion extending generally perpendicular to the longitudinal member.

9. The side grate of claim 7, wherein the first end includes a handle configured to lock the side grate at any one of a plurality of positions on the support post.

10. The side grate of claim 7, wherein the second end is supported spaced apart from the longitudinal sides by cooperation between the first end and the support post only.

11. A side grate for a bed, the bed including a head end, a foot end, and a pair of longitudinal sides extending between the head end and the foot end, the side grate comprising:

a first end configured to be slidably supported on a support post at one of the head end or the foot end of the bed;

a second end opposite to the first end; and a longitudinal portion extending between the first end and the second end;

wherein an entirety of the side grate is configured to be suspended from the support post at the first end only; and wherein the first end includes a first rail configured to slidably cooperate with a first guide groove of the support post and a second rail configured to slidably cooperate with a second guide groove of the support post.

12. The side grate of claim 11, wherein the first end includes a handle configured to lock the side grate at any one of a plurality of positions on the support post.

13. The side grate of claim 11, wherein the first end includes an adjustment device having a generally "U" shaped portion.

14. The side grate of claim 11, wherein the longitudinal portion is configured to extend generally parallel to at least one of the pair of longitudinal sides.

* * * * *